US008641466B2

(12) United States Patent
Ruiz

(10) Patent No.: US 8,641,466 B2
(45) Date of Patent: Feb. 4, 2014

(54) INFANT WATER SKI APPARATUS AND METHOD

(71) Applicant: Roberto G. Ruiz, Dallas, TX (US)

(72) Inventor: Roberto G. Ruiz, Dallas, TX (US)

( * ) Notice: Subject to any disclaimer, the term of this patent is extended or adjusted under 35 U.S.C. 154(b) by 0 days.

(21) Appl. No.: 13/711,738

(22) Filed: Dec. 12, 2012

(65) Prior Publication Data

US 2013/0102211 A1 Apr. 25, 2013

Related U.S. Application Data

(63) Continuation-in-part of application No. 12/785,072, filed on May 21, 2010, now abandoned, which is a continuation-in-part of application No. 29/345,634, filed on Oct. 20, 2009, now Pat. No. Des. 617,407.

(51) Int. Cl.
*B63B 35/81* (2006.01)

(52) U.S. Cl.
USPC ..... 441/68; 441/69

(58) Field of Classification Search
USPC ..... 441/68–70, 65; 114/253
See application file for complete search history.

(56) References Cited

U.S. PATENT DOCUMENTS

| | | | | |
|---|---|---|---|---|
| 2,958,875 | A | 11/1960 | McClain | |
| 3,027,575 | A | 4/1962 | Fortin | |
| D259,803 | S | 7/1981 | Coffin | |
| 4,767,369 | A * | 8/1988 | Snyder | 441/68 |
| 4,981,455 | A | 1/1991 | Tubens | |
| 5,080,620 | A | 1/1992 | Reden | |
| 6,652,422 | B1 | 11/2003 | Day | |
| 6,834,607 | B1 | 12/2004 | Johnson et al. | |
| 6,991,502 | B2 | 1/2006 | Haynes, Jr. | |
| 7,374,180 | B2 | 5/2008 | Farmer | |
| 7,540,797 | B1 | 6/2009 | Blanger | |
| 8,025,541 | B2 | 9/2011 | Churchill et al. | |

* cited by examiner

*Primary Examiner* — Stephen Avila
(74) *Attorney, Agent, or Firm* — Charles D. Gunter, Jr.

(57) ABSTRACT

A platform board is shown which allows a small child or infant to learn the art of water skiing. The platform is wide enough to accommodate at least the width of two foot grips located on an upper surface of the platform. A handle bar extending upwardly from the upper surface of the platform from a location in front of the foot grips. The handle bar includes a grip portion which can be adjusted to lie in a horizontal plane at a height which allows the grip portion to be conveniently gripped by a small child or infant. The platform board is manufactured similarly to a surfboard that will support the weight of a child prior to acceleration of an associated towing craft.

7 Claims, 10 Drawing Sheets

INFANT WATER SKI APPARATUS AND METHOD

CROSS-REFERENCE TO RELATED APPLICATIONS

The present application is a continuation-in-part of earlier filed Ser. No. 12/785,072, filed May 21, 2010, entitled "Infant Water Ski Apparatus and Method" by the same inventor, now abandoned, which was a continuation-in-part of earlier filed design patent application, Ser. No. 29/345,634, filed Oct. 20, 2009, by the same inventor, now U.S. Pat. No. D617,407.

BACKGROUND OF THE INVENTION

1. Field of the Invention

This invention relates generally to a device and method for towing a rider on a water sports apparatus over a body of water behind a towing vessel and, more specifically for such a device for towing a small child or infant on such a water sports apparatus, and a method for manufacturing the same.

2. Description of the Prior Art

Towable water sports devices are used in various recreational and professional activities. These devices include water skis, kneeboards, wakeboards, water ski boards, tubes and other devices which are towed behind a motor boat or other towing vessel along with a rider. In the various water-sports of this type in which a person is towed behind a water-craft, such as water skiing, wakeboarding, knee boarding, air chair riding, float tube (e.g., inner tubes) riding, and the like (collectively referred to herein as "water-tow sports"), the person must typically hold onto a special handle (e.g., a "water ski handle"). The handle, referred to herein as a "water-tow sport handle," is typically connected to one end of a rope having another end connected to the rear of the water-craft, such as a motor powered ski boat.

The use of a conventional water-tow sport handle requires a constant grip which is very tiring, even for an adult, and also requires a good deal of manual dexterity. The use of such a conventional handle is beyond the capability of many younger children, especially in the case of an infant having the desire to learn to ski.

In the case of adult skiers, many different alternative structures have been proposed to improve upon the traditional ski handle arrangement. For example, in U.S. Pat. No. 6,991,502, shows a belt which is configured to be worn around a person's waist, and a holder secured to the belt. The holder is configured to hold onto a water-tow sport handle. The holder can hold the water-tow sport handle while the belt is being worn around the person's waist and as the handle is being pulled away from the belt, for example by a rope attached to the rear of a watercraft. During use, a special pin arrangement is provided which advantageously breaks to release the portion of the holder that holds onto the water-tow sport handle when the user falls during skiing, wakeboarding, or the like.

Despite the various problems with traditional water-tow sport handles of the type described above, designers of water ski equipment have not generally adopted alternative designs involving tow bars or handle bars attached to ski's or water boards. U.S. Pat. No. 7,374,180, shows a snowboard "scooter" formed of a one-piece platform wide enough to accommodate the width of two feet. This snowboard design also features a fixable post and a handlebar, and a brake system actuated either at the handlebar or by direct contact with one of the user's feet. However, the design is not practical for use on water.

U.S. Pat. No. 6,652,422, is another prior art design which shows a special vehicle designed to glide on snow or ice. The vehicle is formed of a footboard with a runner at each longitudinal end thereof, a steering handlebar fastened pivotally with the front end of the footboard, and a braking device fastened with the rear end of the footboard. Again, the device is not practical for use on water.

U.S. Pat. No. 8,025,541, shows a water sport training device in the form of a raft having an inflatable upper bladder support upon a pliable foam body board. In use, a person straddles a seat portion of the device with the feet being supported on either side of the seat on the body board. The device is relatively bulky, more in the nature of a watercraft than a ski training device and fails to give a user a more realistic feeling of the actual water skiing experience.

A need continues to exist for improvements in the design of water sports equipment of the described, especially in the area of equipment intended to be used by small children or infants.

SUMMARY OF THE INVENTION

The water ski apparatus of the invention allows young children and infants to more easily learn the art of water skiing, water boarding, and the like. The apparatus includes a platform having an upper surface, a lower surface, a thickness, a front extent and a rear extent, the platform being wide enough to accommodate at least the width of two feet. A pair of foot grips are located on the upper surface of the platform in a side-by-side location on opposite sides of a longitudinal axis of the platform. A handle bar extends upwardly from the upper surface of the platform from a location in front of the foot grips. The handle bar is comprised of a pair of oppositely arranged vertical side posts with an intermediate horizontal grip portion connecting the pair of vertical side posts. A tow point is located at the front extent of the platform for receiving a tow rope for pulling the platform over a surface of water.

The grip portion of the handle bar lies in a horizontal plane which is located at a predetermined distance above the top surface of the platform, the distance being such that the grip portion can be conveniently gripped by a small child or infant. Preferably, the grip portion of the handle bar lies in a horizontal plane which is between about 12 and 36 inches above the top surface of the platform, most preferably about 12 to 30 inches above the top surface of the platform. The handle is preferably adjustable to accommodate young children of different heights The platform can be provided in the form of a water ski board having an upper support surface in the form of a continuous planar surface. The platform can also assume other alternative forms. For example, the platform can be provided in the form of a surf-board type support surface that will support the weight of a child prior to the acceleration of the associated towing craft.

In a particularly preferred form of the invention, the platform is manufactured with a buoyant core which is formed from a blank of a lightweight expanded foam, such as polyurethane foam. The foam is fluid enough initially to be poured and can be molded to the desired shape. As it sets, the foam expands and becomes rigid, and because the foam is preferably closed cell, it will resist the absorption of water. Once hardened, the polyurethane foam core can be "glassed" by coating with any of several types of epoxy, resin or polyester laminate layers to produce the finished support surface. The upper support surface has a pair of spaced-apart foot grips and a handle bar which is adjustably resizable to accommodate the height of an infant or small child.

The handle bar is preferably provided as a telescoping member. For example, the vertical side posts of the handle bar can be provided as upright cylindrical members with the handle bar grip portion having a pair of downwardly extending vertical leg portions which are received within the cylindrical members in telescoping fashion. The handle bar vertical side posts are also removably attached to the upper surface of the platform in the preferred version of the invention, whereby the handle bar can be stored in collapsed fashion on top of the upper surface of the platform when not in use, or removed entirely.

Additional objects, features and advantages will be apparent in the written description which follows.

DETAILED DESCRIPTION OF THE INVENTION

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
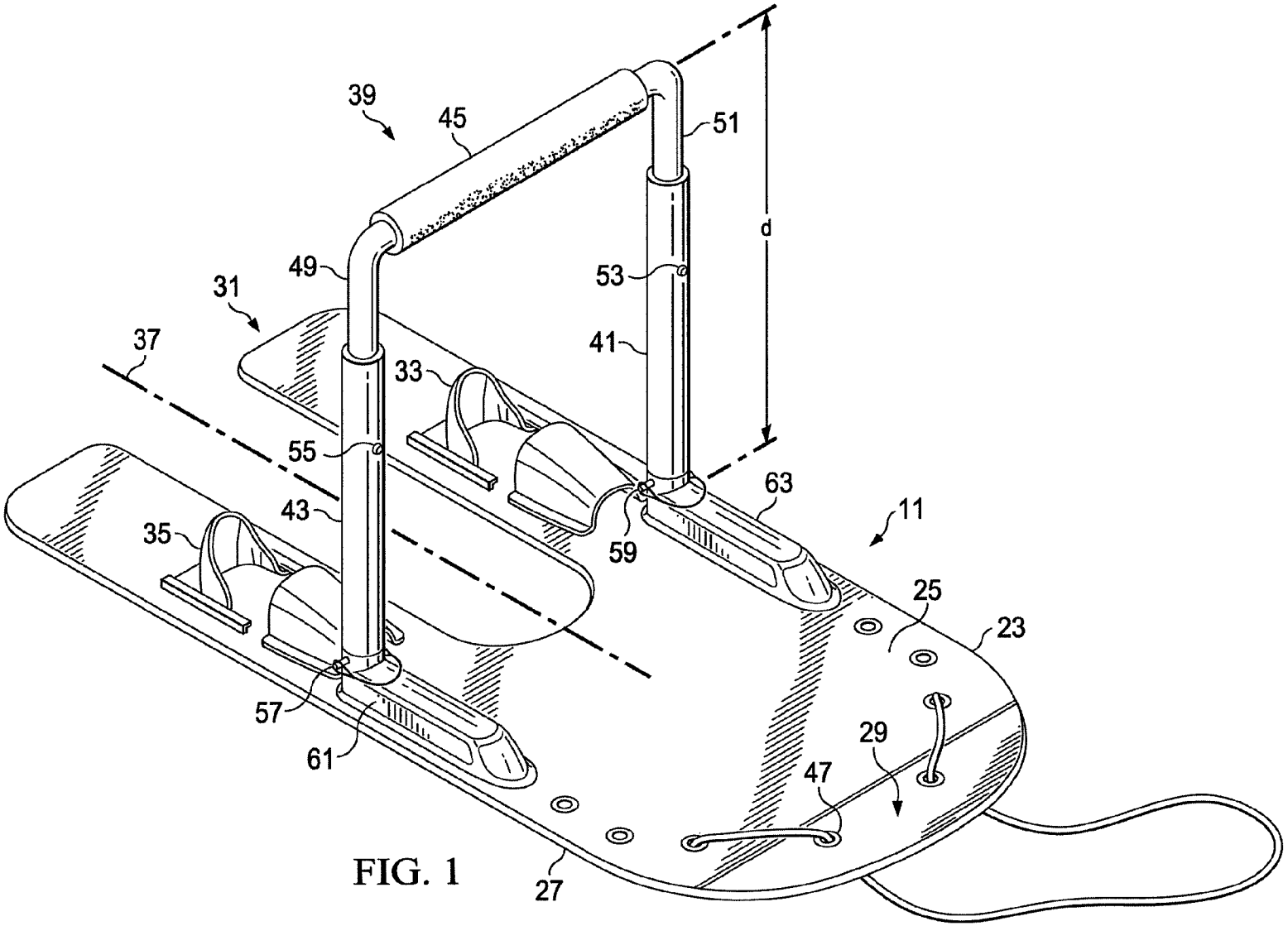
FIG. 1 is a perspective view of a water sport apparatus of the invention, showing the telescoping gripping handle thereof.
Figure 2:
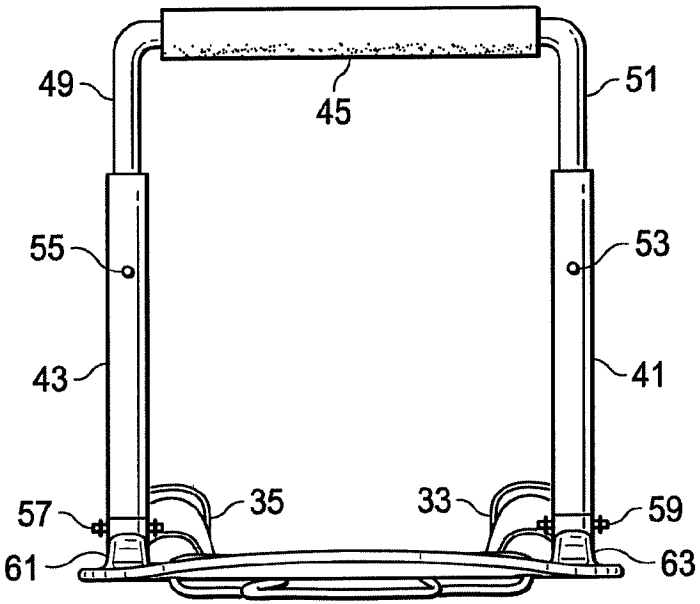
FIG. 2 is a front view of the apparatus of the invention of FIG. 1.
Figure 3:
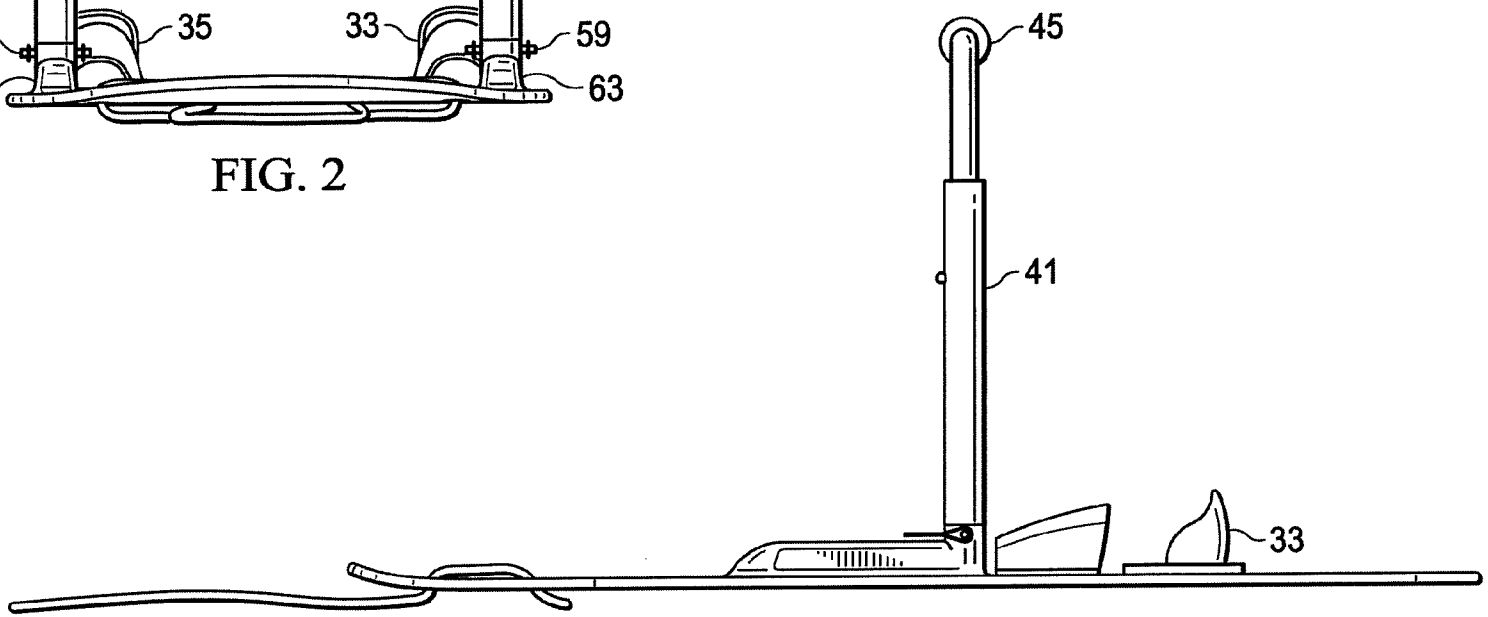
FIG. 3 is a left side view of the apparatus of FIG. 1.
Figure 4:
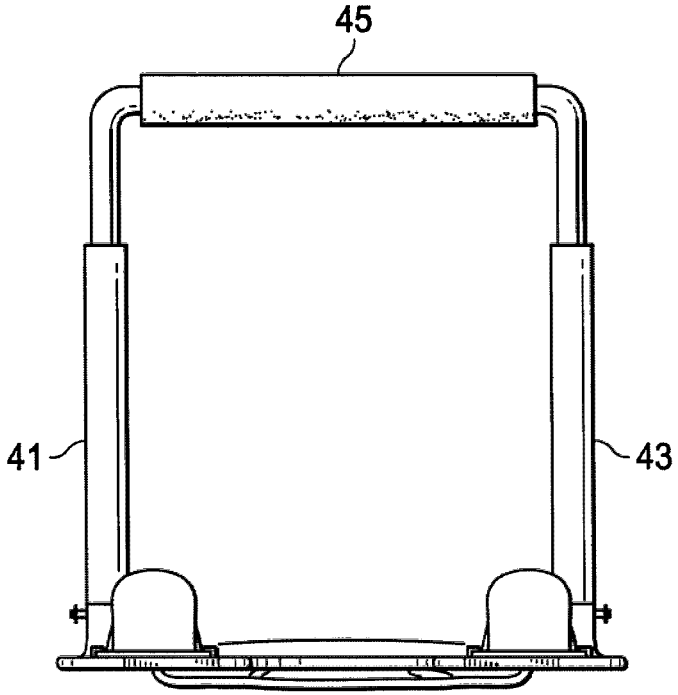
FIG. 4 is a rear view of the apparatus of the invention.
Figure 5:
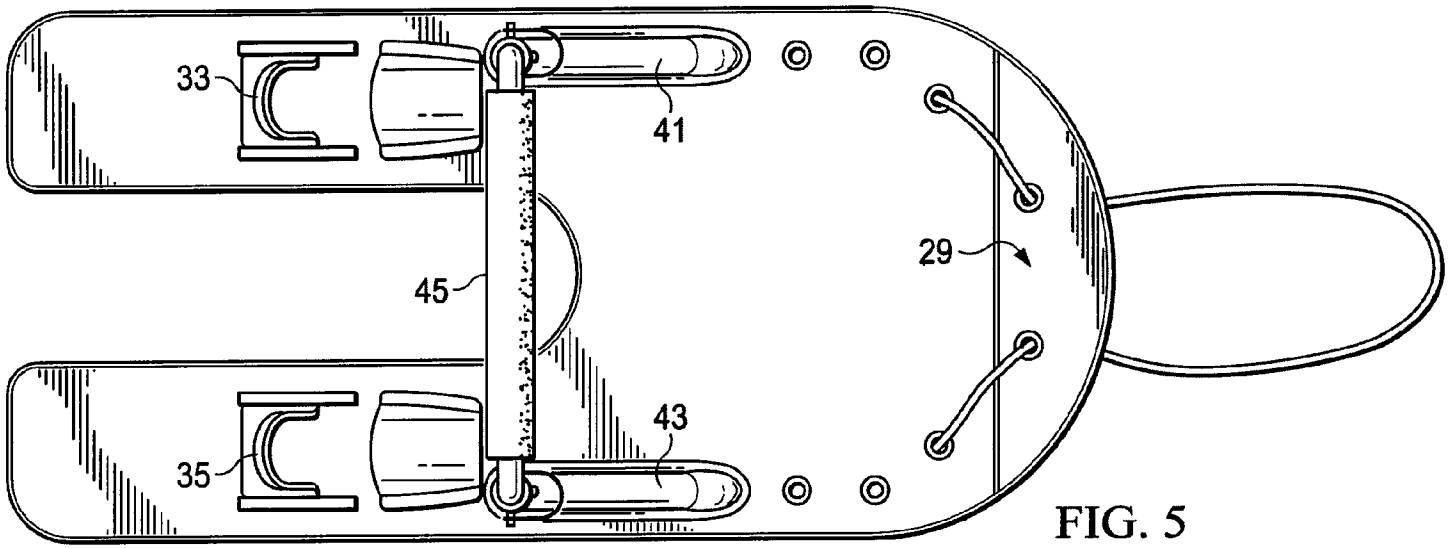
FIG. 5 is a top view of the water sport apparatus of the invention.
Figure 6:
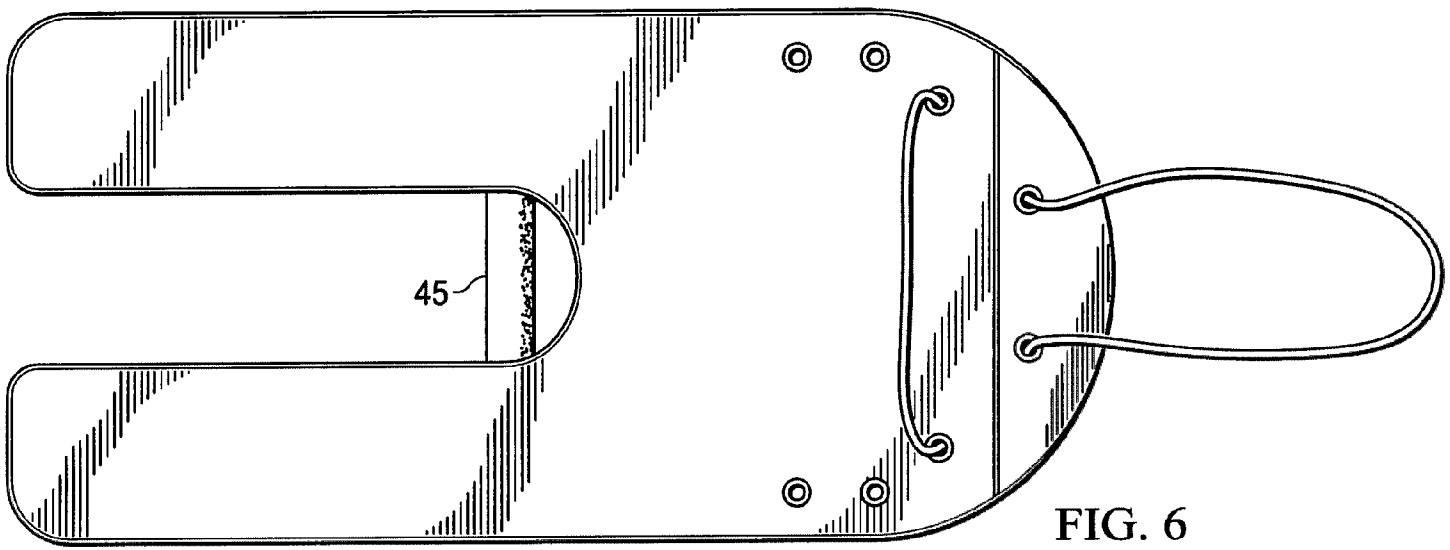
FIG. 6 is a bottom view of the apparatus of FIG. 5.
Figure 7:
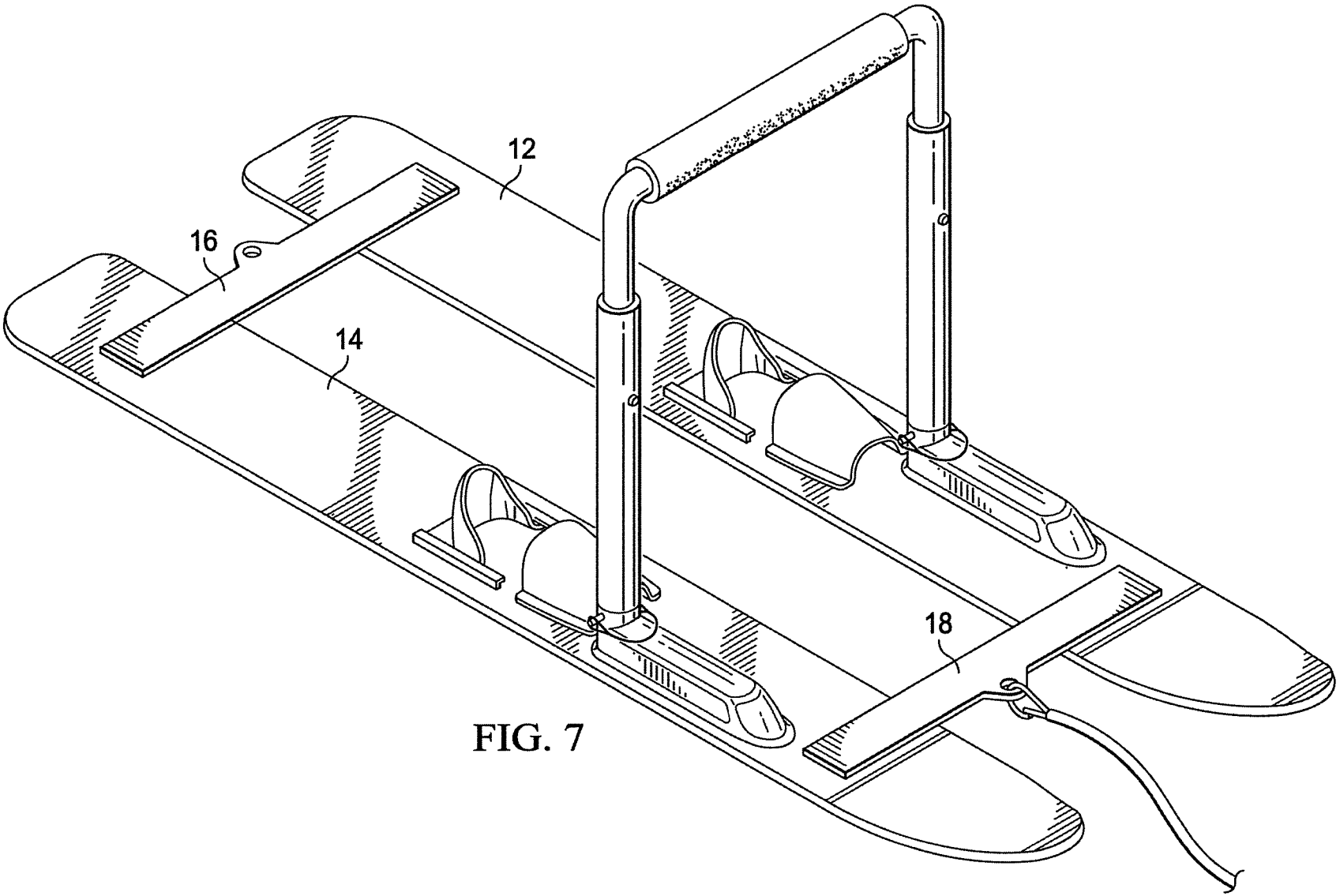
FIG. 7 is an alternative design for the water sport apparatus of the invention.

As has been briefly described, the present invention is concerned with the field of water-tow sports in which a person is towed behind a watercraft, such as while water skiing, wakeboarding, and the like. FIG. 1 depicts a water sports apparatus of the invention which is used to tow a rider over a body of water with a watercraft towing vessel. In the depicted example, the water sports apparatus is implemented as a water ski board 11, although it will be appreciated from the discussion which follows that water skis or other towable water sports devices may incorporate the principles of the present invention. For example, the platform shown in FIG. 1 is a water ski board having a front extent in the form of a continuous planar surface. However, FIG. 7 shows another form of towable water sports device which is comprised of a pair of laterally aligned but spaced-apart ski boards, 12, 14, the boards being joined at front and rear extents thereof by connecting cross members 16, 18. The cross members could be formed of a variety of materials. In the embodiment of the device shown in FIG. 7, the cross members are formed of a relatively rigid but flexible plastic material. Whatever the form of the water towable device, the rider is typically towed over a body of water by a towing vessel such as motorized ski boat.

Figure 9:
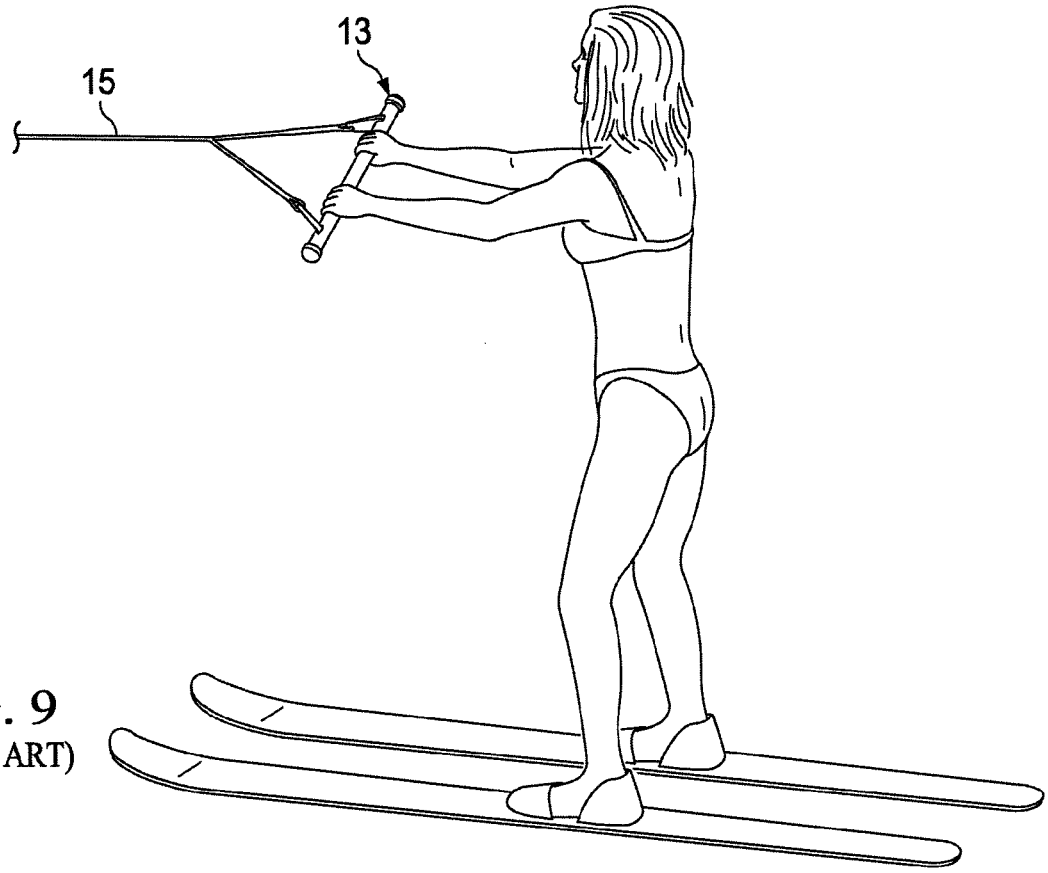
FIG. 9 (PRIOR ART)
FIG. 9 is a view of a prior art handle being gripped by a water skier in the traditional manner.

In the case of prior art water sports devices of the type under consideration, the rider typically grasps a traditional water ski handle (13 in FIG. 9). The handle 13 is, in turn, connected to a tow point on the motor boat by a towline 15. Towing force is imparted to rider via the towline 15 upon forward motion of boat over the body of water. It will be appreciated that rider towline 15 and handle 13 provide force components in both a horizontal direction and a vertical direction. The horizontally directed force causes rider and the water ski board to be conveyed horizontally over the surface of the water.

Figure 8:
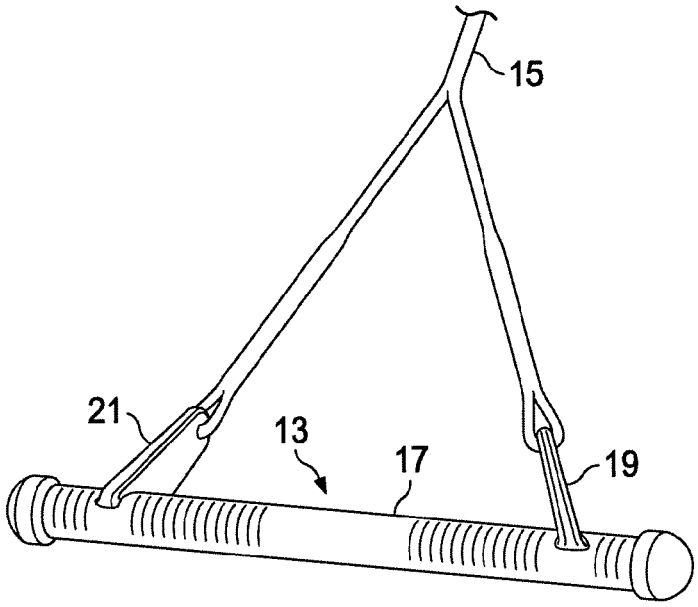
FIG. 8 (PRIOR ART)
FIG. 8 is a view of a prior art handle for a water sport apparatus of the type under consideration.

A typical water-tow sport handle 13 is illustrated in FIG. 8. This particular prior art handle comprises a rigid tubular handle grip member with inclined tow rope attachment points 19 and 21. The tubular handle grip member is adapted to be gripped by a user and has a diameter appropriate for being gripped by a person's hands. The handle 13 is connected or configured to be connected to the tow rope 15 with the rope being secured to the rear of a watercraft (not shown) so that a person holding the handle 13 can be pulled along behind the watercraft. FIG. 9 shows a water skier using the prior art handle 13. The use of a conventional water-tow sport handle requires a constant grip on the handle segment 17, which is very tiring and requires a good deal of manual dexterity. The use of the traditional ski rope handle is thus beyond the abilities of many young children or infants.

FIG. 1 shows one version of Applicant's improved apparatus for performing a gliding sport on water, and particularly for training a young child or infant to water ski. The apparatus of the invention includes a platform 23 having an upper surface 25, a lower surface 27, a thickness therebetween, a front extent 29 and a rear extent 31, the platform being wide enough to accommodate at least the width of two feet. In the case of the water ski board 11 shown in FIG. 1, the platform forms a continuous flat planar surface at the front extent 29 and is divided at the rear extent 31. The platform is typically made from a buoyant material, such as bamboo wood, or is provided as one or more plies of material with at least one of the plies being formed of a buoyant material. As can be seen in FIG. 1, a pair of foot grips 33,35 are located on the upper surface 25 of the platform in a side-by-side location on opposite sides of a longitudinal axis 37 of the platform.

A handle bar (denoted generally as 39 in FIG. 1) extends upwardly from the upper surface 25 of the platform 11 from a location in front of the foot grips 33, 35. The handle bar is comprised of a pair of oppositely arranged vertical side posts 41, 43, and an intermediate horizontal grip portion 45 connecting the pair of vertical side posts 41, 43. A tow point (generally at 47 in FIG. 1) is located at the front extent 29 of the platform for receiving a tow rope for pulling the platform over a surface of water.

As will be appreciated from FIG. 1, the grip portion 45 of the handle bar lies in a horizontal plane which is located at a predetermined distance (indicated as "$d_1$" in FIG. 1) above the top surface 25 of the platform, the distance being such that the grip portion can be conveniently gripped by a small child or infant. Preferably, the grip portion 45 of the handle bar lies in a horizontal plane such that the distance "$d_1$" is between about 12 and 36 inches above the top surface 25 of the platform. Most preferably, the grip portion of the handle bar lies in a horizontal plane which is between about 12 and 30 inches above the top surface of the platform. Also, the handle bar is also adjustably resizable to accommodate the height of a small child or infant.

In one preferred form of the invention, the vertical side posts 41, 43, of the handle bar 39 are upright cylindrical members and wherein the handle bar grip portion 45 has a pair of downwardly extending vertical leg portions 49, 51, which are received within the cylindrical members in telescoping fashion. Detents 53, 55 are provided to hold the vertical leg portions 49, 51 in a plurality of different vertical positions relative to the platform upper surface 25. Additionally, the handle bar vertical side posts 41, 43 can be removably attached to the upper surface of the platform, whereby the handle bar can be stored in collapsed fashion on top of the upper surface of the platform when not in use. Alternatively, the vertical side posts 41, 43, can be removed entirely. In the example of FIG. 1, cotter pins 57, 59 are receiving in mating holes provided in base supports 61, 63, and in the vertical posts 41, 43, respectively, whereby removal of the pins 57, 59 allow the vertical posts 41, 43 to be released.

The version of the invention presented in FIGS. 1-6 worked suitably for its intended purpose. However, the water ski board or platform 11, while made from a buoyant material such as bamboo or balsa wood, failed to adequately support a child's weight prior to acceleration of the associated towing craft. Because it was necessary to get the board up to speed before the child's weight was supported, the child could slip from the board, or find it difficult to mount the board. This made it difficult, in some cases, for a young child to begin the training process.

Figure 12:
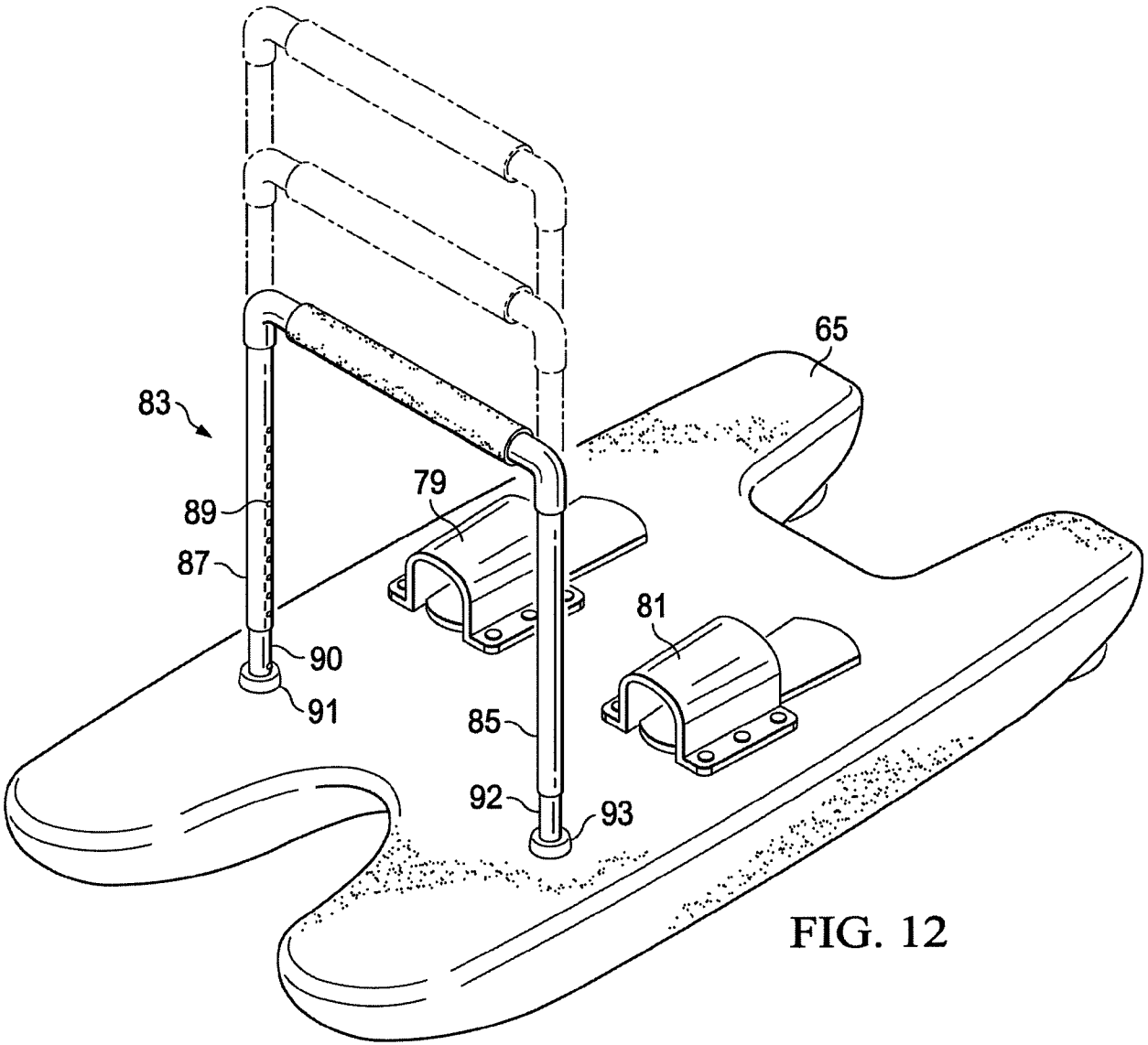
FIG. 12 shows the completed water sport apparatus showing the foot grips and handle bar which is adjustably resizable to accommodate the height of an infant or small child.

FIG. 12 shows another version of the improved infant water ski apparatus of the invention. In this case, the platform 65 is provided in the form of a surf-board type support that will support the weight of a child prior the acceleration of the associated towing craft. In other words, the platform 65 will float behind the towing craft even when the towing craft is at a standstill.

In a particularly preferred form of the invention, the platform is manufactured with a buoyant core which is formed from a blank of a lightweight expanded foam, such as polyurethane foam. The foam is fluid enough initially to be poured and can be molded to the desired shape. As it sets, the foam expands and becomes rigid, and because the foam is preferably closed cell, it will resist the absorption of water. Once hardened, the polyurethane foam core can be coated with any of several types of epoxy, resin or polyester laminate layers to produce the finished support surface.

Figure 10:
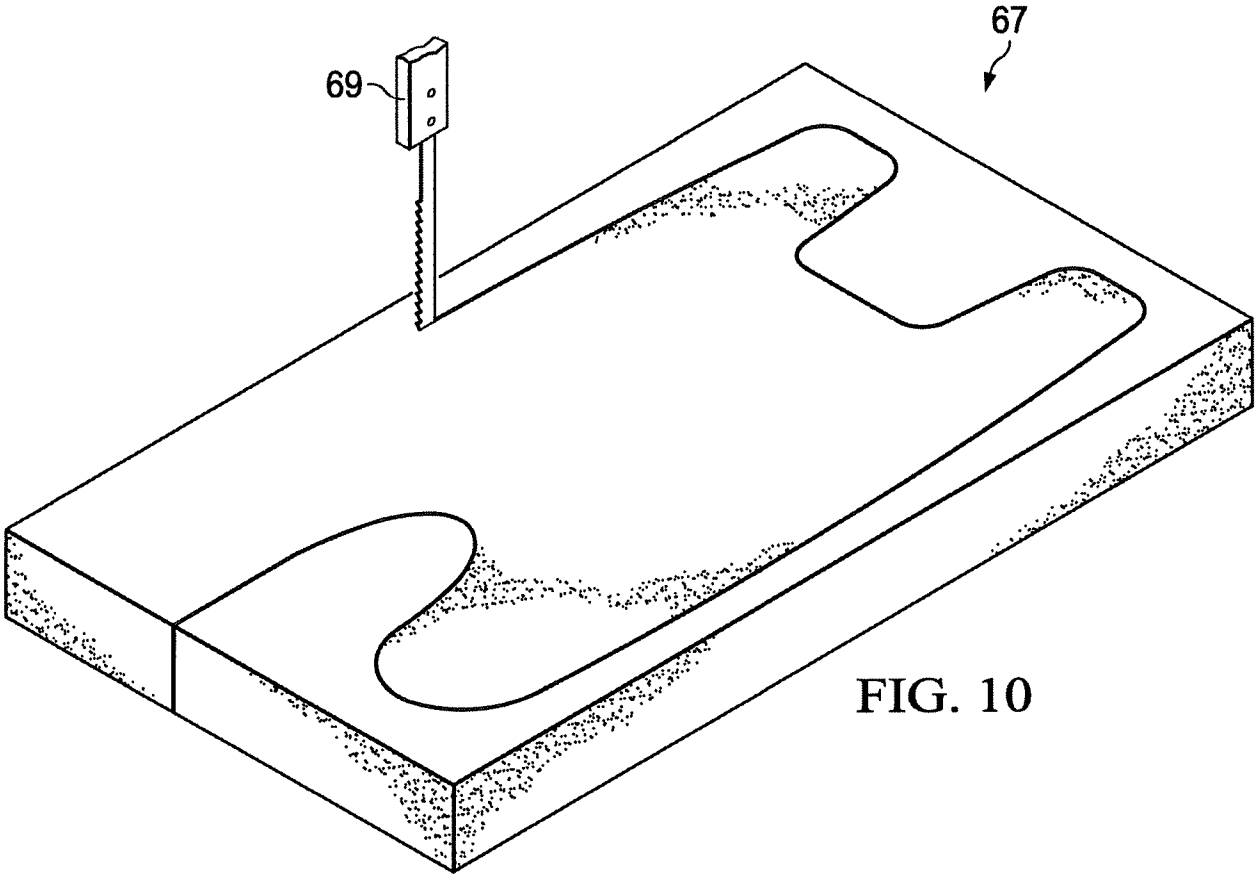
FIG. 10 is a simplified view of the first step in the manufacturing process used to produce another form of the water sport apparatus of the invention in which a form is cut from a block of expanded polyurethane.

FIGS. 10-13 illustrate, in simplified fashion, the steps used in manufacturing the surf-board type support (the final product being shown in FIG. 12). At the first stage of production, a foam "blank" is first produced from which the basic shape of the water sport apparatus will be obtained. Although various lightweight expanding foams might be utilized, a closed cell, polyurethane foam is a commercially available lightweight foam which is used in many flotation and insulation applications. Since the liquid foam is initially fluid enough to be poured, it can be molded to various shapes. The foam core can be formed by pouring the polyurethane liquid into a mold and heating the mold. The heat triggers a chemical reaction, creating a dense, white foam body. In FIG. 10, a rectangular block of foam 67 has been poured and allowed to expand and set.

FIG. 10 shows the basic outline of the water sports board of the invention being cut from the form with a saw 69. The contours of the board can easily be achieved by hand cutting and sanding. For example, the foam blank might be cut with, for example a saber saw, with the final contours being shaped with a power planar. Of course, various types of commercially available automated cutting and shaping equipment might be utilized to cut the board outline as well as shape the final contours of the board.

Figure 11:
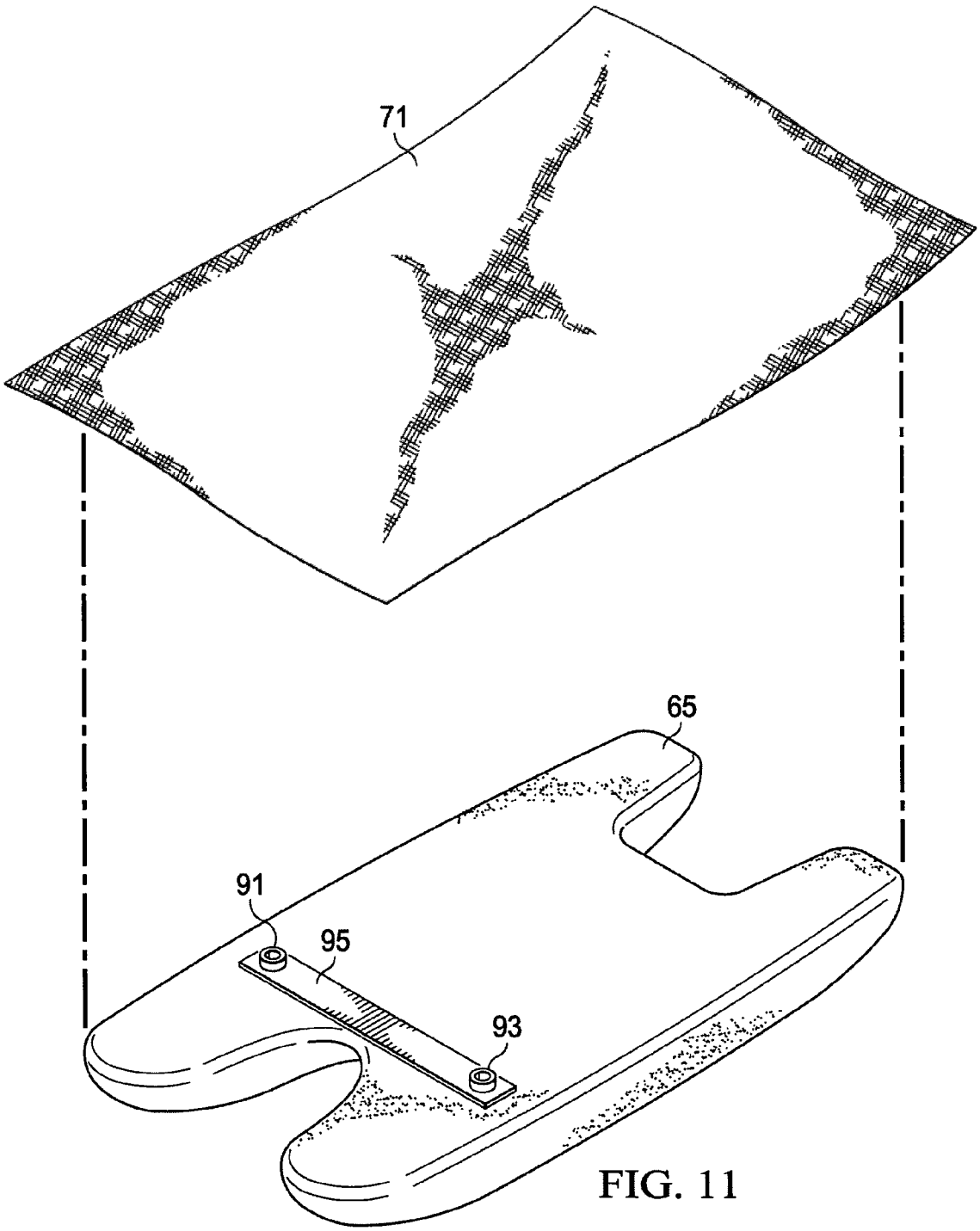
FIG. 11 shows the next step in the manufacturing process in which a fiberglass cloth is used to cover the polyurethane foam core, the cloth being subsequently coated with a epoxy, resin or polyester coating.

FIG. 11 shows, in simplified fashion, the next steps in the manufacturing process in which the expanded polyurethane "blank" is "glassed" to form the final product. In the "glassing" step, a fiberglass sheet 71 is used to cover the blank and cut to fit. An appropriate laminating resin is then applied to consolidate the sheet and laminating coating material. The coating material can be any of those familiar to those skilled in the fiberglass arts including, for example, epoxy, resin or polyester. For example, epoxies are polymers that set, or cure, when mixed with a hardening catalyst. Common epoxy resins are produced from a reaction between epichlorohydrin and bisphenol-A and will be well familiar to those skilled in the relevant arts. The board will typically then be flipped and the bottom surface 77 will be glassed. The fins (73, 75 in FIG. 13) will then be affixed, as by using fiberglass tape and a laminating resin. The product is then finish sanded and polished.

Figure 13:
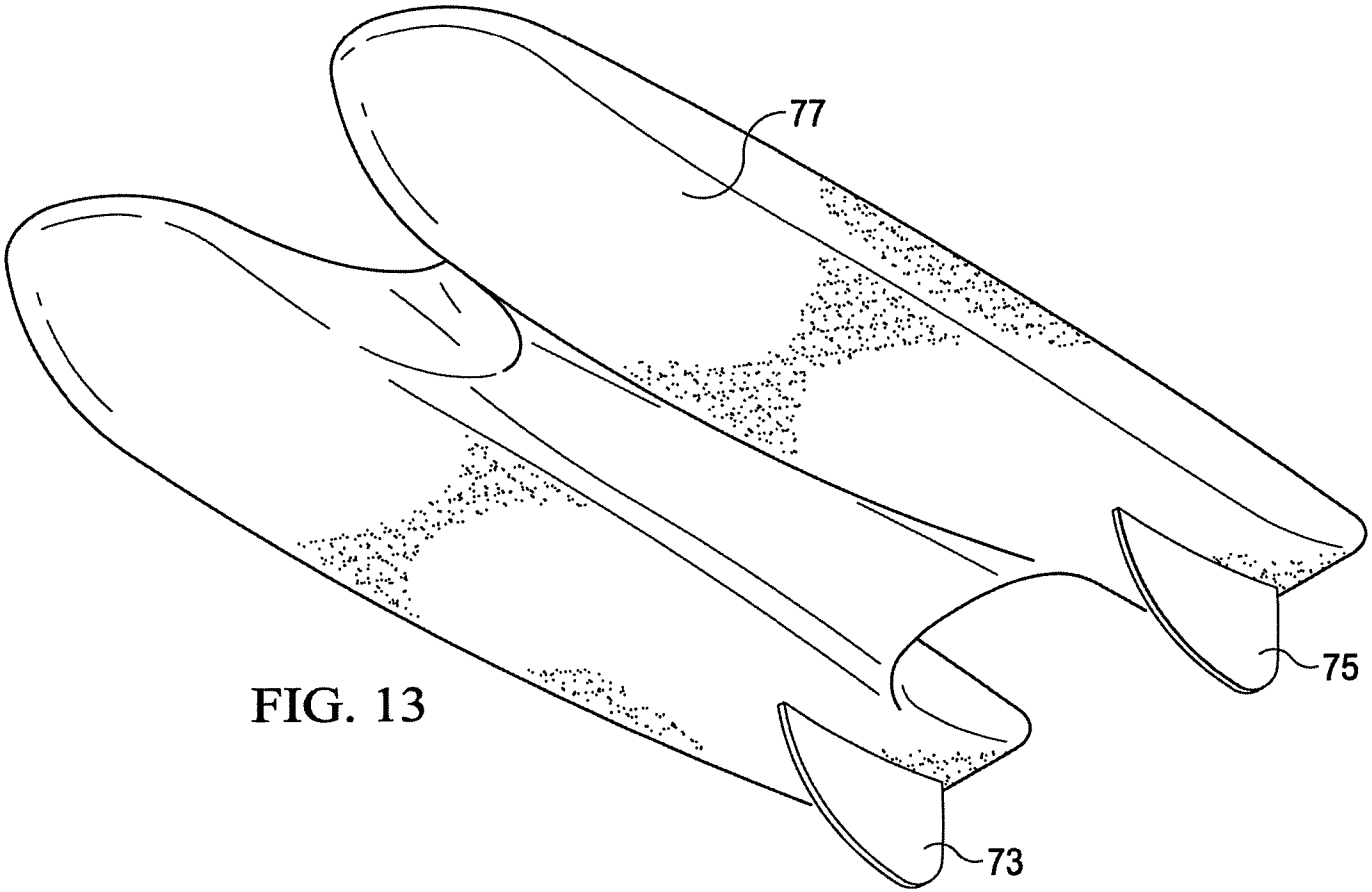
FIG. 13 shows the bottom surface of the water sport apparatus of FIG. 12 showing the fins and bottom contour of the apparatus.

As with the first version of the invention, the water sport apparatus of FIGS. 12 and 13 includes a pair of spaced-apart foot grips 79, 81, which are attached to the board upper surface, as by screws. A handle bar 83 is also provided which is adjustably resizable to accommodate the height of an infant or small child. The handle bar can conveniently be provided as a telescoping member with the vertical sideposts 85, 87, being provided as upright cylindrical members which are received one-within-the-other with respect to an associated vertical upright in telescoping fashion. A number of openings 89 are provided on the outer upright for receiving detents located on the inner upright for adjustably positioning the handle bar. The handle bar vertical side posts are also removably attached to the upper surface of the platform in the preferred version of the invention, whereby the handle bar can be stored in collapsed fashion on top of the upper surface of the platform when not in use, or removed entirely.

The handle bar uprights 83, 85 are secured by installing the uprights 90, 92, within a pair of spaced cylindrical receptacle elements 91, 93. The receptacle elements are physically "embedded" within the material of the board 65. This can be accomplished in various ways. In FIG. 11, a support bar is enclosed by the laminating layer 71. The bar 95 helps to support the upright receptacles 91, 93. Alternatively, holes can be drilled in the board 65 after glassing. The plastic receptacle tubes 91, 93 are then placed within the holes and set with epoxy resin. Fin rope (fiberglass rope) can then be used to wrap the protruding sleeves and cured with a suitable resin and catalyst to provide reinforcement.

An invention has been provided with several advantages. The infant water ski apparatus of the invention is simple in design and economical to manufacture. When provided in the form of a surfboard like platform support, it supports the weight of a young child prior to the associated tow craft getting up to speed in the water. The specially located handle can be more easily gripped by a small child or infant without getting pulled out of their hands, unlike the traditional water ski handle designs of the prior art. The water sports apparatus of the invention facilitates learning the art of water skiing or water boarding by even very young children and infants.

While the invention has been shown in various of its forms, it is not thus limited but is susceptible to various changes and modifications without departing from the spirit thereof.

What is claimed is:

1. A water sport training apparatus for training a small child or infant to water ski, the apparatus comprising:

a platform having an upper surface, a lower surface, a thickness, a front extent and a rear extent, the platform being wide enough to accommodate at least the width of two feet;

a pair of foot grips located on the upper surface of the platform in a side-by-side location on opposite sides of a longitudinal axis of the platform;

a handle bar extending upwardly from the upper surface of the platform from a location in front of the foot grips, the handle bar being comprised of a pair of oppositely arranged vertical side posts and an intermediate horizontal grip portion connecting the pair of vertical side posts, the handle bar being adjustably resizable to accommodate the height of an infant or small child;

a tow point located at the front extent of the platform for receiving a tow rope for pulling the platform over a surface of water with an associated towing craft;

wherein the grip portion of the handle bar lies in a horizontal plane which is located at a predetermined distance above the top surface of the platform, the distance being such that the grip portion can be conveniently gripped by a small child or infant, the horizontal plane of the grip portion of the handle bar being between about 12 and 36 inches above the top surface of the platform; and wherein the platform is comprised of a surf-board type support surface, manufactured with a buoyant core which is formed from a blank of a lightweight expanded foam that will support the weight of a child prior to acceleration of the associated towing craft.

2. The apparatus of claim 1, wherein the grip portion of the handle bar lies in a horizontal plane which is between about 12 and 30 inches above the top surface of the platform.

3. The apparatus of claim 1, wherein the handle bar vertical side posts are removably attached to the upper surface of the platform, whereby the handle bar can be stored in collapsed fashion on top of the upper surface of the platform when not in use.

4. The apparatus of claim 1, wherein the lightweight foam is polyurethane foam.

5. The apparatus of claim 4, wherein the polyurethane foam core is glassed with fiberglass cloth and a suitable laminating resin.

6. The apparatus of claim 1, wherein the oppositely arranged vertical sideposts of the handle bar are secured to the platform by installing the uprights within a pair of spaced cylindrical receptacle elements which are physically embedded within the material of the platform.

7. The apparatus of claim 6, wherein the cylindrical receptacles are enclosed by layers of lamination of the laminated platform.

* * * * *